US009091494B2

(12) United States Patent
Dahlberg

(10) Patent No.: US 9,091,494 B2
(45) Date of Patent: Jul. 28, 2015

(54) PLATE HEAT EXCHANGER

(75) Inventor: Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 555 days.

(21) Appl. No.: 11/547,776

(22) PCT Filed: Mar. 22, 2005

(86) PCT No.: PCT/SE2005/000409
§ 371 (c)(1),
(2), (4) Date: Dec. 18, 2006

(87) PCT Pub. No.: WO2005/098334
PCT Pub. Date: Oct. 20, 2005

(65) Prior Publication Data

US 2007/0227716 A1 Oct. 4, 2007

(30) Foreign Application Priority Data

Apr. 8, 2004 (SE) ..... 0400931

(51) Int. Cl.

| | |
|---|---|
| ***F28F 19/02*** | (2006.01) |
| ***F28F 3/08*** | (2006.01) |
| ***F28F 17/00*** | (2006.01) |
| ***F28D 9/00*** | (2006.01) |
| ***F28F 3/04*** | (2006.01) |

(52) U.S. Cl.
CPC ..... *F28F 17/005* (2013.01); *F28D 9/005* (2013.01); *F28F 3/04* (2013.01); *F28F 2275/04* (2013.01)

(58) Field of Classification Search
CPC ..... F28F 3/08; F28F 19/02
USPC ..... 165/167
See application file for complete search history.

(56) References Cited

U.S. PATENT DOCUMENTS

| | | | | |
|---|---|---|---|---|
| 4,987,955 | A | 1/1991 | Bergqvist et al. | |
| 5,099,912 | A * | 3/1992 | Tajima et al. | 165/133 |
| 5,291,945 | A * | 3/1994 | Blomgren et al. | 165/167 |
| 5,462,113 | A | 10/1995 | Wand | |
| 5,522,462 | A * | 6/1996 | Kumar et al. | 165/166 |

(Continued)

FOREIGN PATENT DOCUMENTS

| | | |
|---|---|---|
| CN | 1328632 | 12/2001 |
| EP | 1 094 291 A2 | 4/2001 |

(Continued)

OTHER PUBLICATIONS

Japanese Office Action dated Feb. 1, 2011 from corresponding JP Application No. 2007-507269.
Taiwanese Office Action for corresponding Taiwanese Application No. 94110175 (Patent No. I315780) issued May 15, 2009.

*Primary Examiner* — Frantz Jules
*Assistant Examiner* — Erik Mendoza-Wilkenfel
(74) *Attorney, Agent, or Firm* — Merchant & Gould P.C.

(57) ABSTRACT

The invention relates to a plate heat exchanger in which the heat exchanging plates are brazed together along the periphery (17) of the exchanger and around port holes (2',4') in neighboring plates to prevent that the heat exchanging flows mix when flowing through port channels comprising said port holes (2',4'). In order to facilitate draining of heat exchanging media from the exchanger and in order to obtain better exploitation of the heat exchanger volume the sealing of neighboring plates around port holes may according to the invention be effected in different plans (24, 25).

1 Claim, 10 Drawing Sheets

(56) References Cited

U.S. PATENT DOCUMENTS

| | | | | |
|---|---|---|---|---|
| 5,913,361 | A * | 6/1999 | Engstrom et al. | 165/70 |
| 5,988,269 | A * | 11/1999 | Karlsson et al. | 165/167 |
| 6,164,371 | A * | 12/2000 | Bertilsson et al. | 165/140 |
| 6,170,567 | B1 * | 1/2001 | Nakada et al. | 165/153 |
| 6,305,466 | B1 * | 10/2001 | Andersson et al. | 165/140 |
| 6,394,179 | B1 | 5/2002 | Blomgren et al. | |
| 6,752,202 | B2 * | 6/2004 | Holm et al. | 165/167 |
| 7,246,436 | B2 * | 7/2007 | Blomgren et al. | 29/890.039 |
| 7,426,957 | B2 * | 9/2008 | Hendrix et al. | 165/166 |
| 2001/0018968 | A1 * | 9/2001 | Klingler et al. | 165/140 |
| 2005/0178536 | A1 * | 8/2005 | Blomgren et al. | 165/167 |
| 2007/0084592 | A1 * | 4/2007 | Hendrix et al. | 165/166 |

FOREIGN PATENT DOCUMENTS

| | | | |
|---|---|---|---|
| EP | 1 394 491 | A2 | 3/2004 |
| FR | 2 679 021 | A1 | 1/1993 |
| JP | 60-176371 | | 11/1985 |
| JP | 10-288479 | | 10/1998 |
| JP | 2002-539407 | | 11/2002 |
| TW | 336272 | | 7/1998 |
| WO | WO 98/48230 | A1 | 10/1998 |
| WO | WO 9848230 | A1 * | 10/1998 |
| WO | WO 99/36740 | A1 | 7/1999 |
| WO | WO 03058142 | A1 * | 7/2003 |

* cited by examiner

PLATE HEAT EXCHANGER

The present invention relates to a plate heat exchanger comprising a plurality of stacked plates for guiding two or more flows of heat exchanging media, said plates being brazed together along the periphery of neighbouring plates and around port holes in pairs of neighbouring plates to prevent that the heat exchanging flows mix when flowing through port channels comprising said port holes in the exchanger.

BACKGROUND OF THE INVENTION

Heat exchangers of this type are often manufactured in large series e.g. for use in dwelling houses to provide hot water for household use and/or for heating purposes. Other applications include use in heat pumps and air conditioners.

In known heat exchangers of this type the brazing of pairs of plates around port holes is performed in a ring shaped area located in a single plan—the plan of the edge of the sort holes. The port holes are located at least at such a distance from the outer periphery of the exchanger as to allow a reliable sealing around the port holes.

Heat exchangers of this type have been described e.g. in EP 1 +94 291 A, U.S. Pat. No. 4,987,955 A and in U.S. Pat. No. 5,988,296 A. In all these known heat exchangers it is necessary to flush and shake to obtain an effective cleaning. Also a part of the heat exchanger does not offer the best possible capacity of exchanging heat.

OBJECT OF THE INVENTION

It is a general desire to provide the heat exchangers at a low manufacturing cost and with small outer dimensions relative their heat exchanging capacity. The weight of the exchanger should be small and the total heat exchanging area of the plates should be a high percentage of their total area. In many cases it is desirable to be able to clean the exchanger in simple way.

BASIC FEATURE OF THE INVENTION

According to the present invention this object is obtained in the type of heat exchanger referred to above thereby that the brazing connections at the edges around each of the port holes at least in one of the port channels in the heat exchanger in order to be able to drain the exchanger have been arranged partly between contacting parts of the plates located in the general plan of the plates, partly between contacting parts forming circumferential rims.

DESCRIPTION OF THE DRAWINGS

The invention will be explained below in more detail, reference being made to the accompanying drawings in which FIG. 1 schematically and from above shows a plate of a known plate heat exchanger, FIG. 2 schematically shows a section along the line x-x of FIG. 1 through a heat exchanger provided with a stack of plates of the type shown in FIG. 1, FIG. 3 schematically shows a section along the line y-y of FIG. 1 through a heat exchanger provided with a stack of plates of the type shown in FIG. 1.

DETAILED DESCRIPTION OF THE CONTENTS OF THE DRAWINGS

Figure 1:
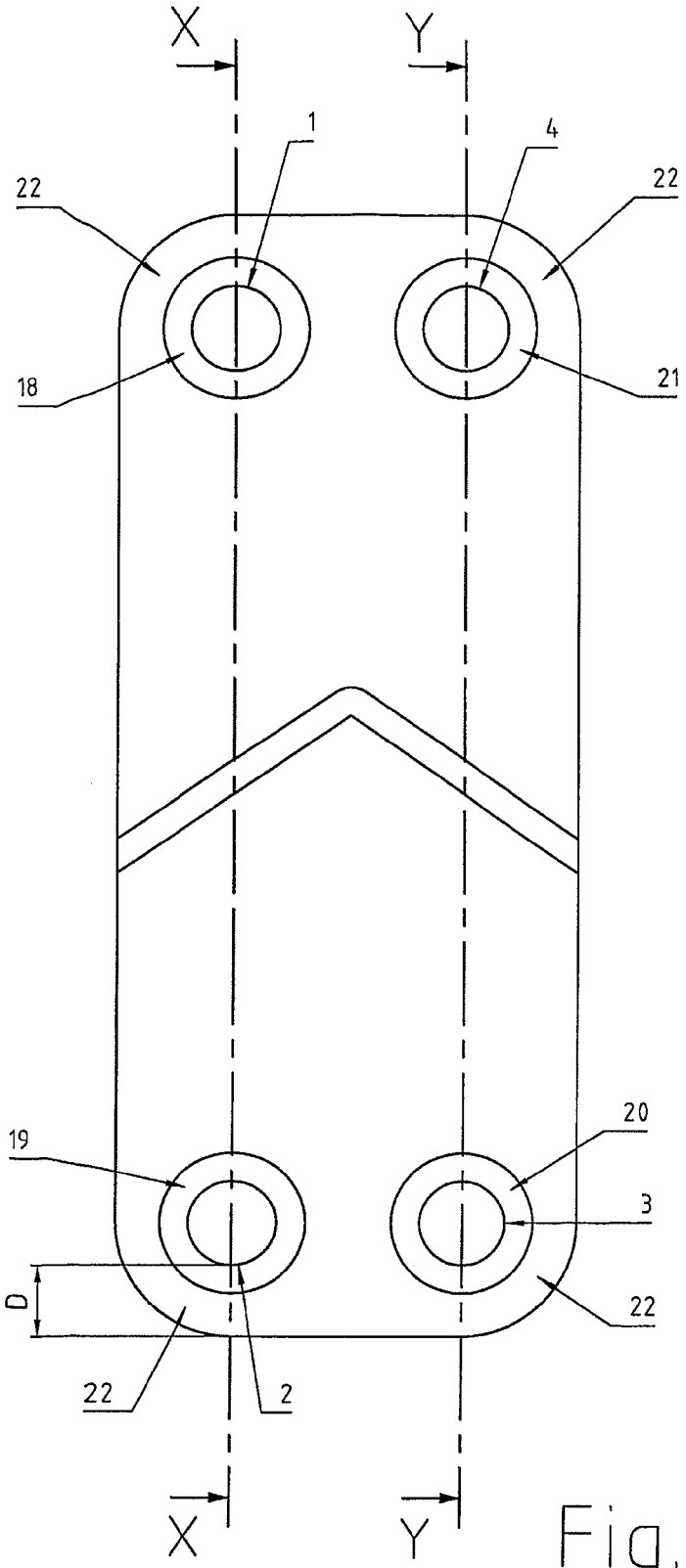
Fig. 1 (Prior Art)

The heat exchanger plate schematically shown in FIG. 1 is provided with an inlet port hole 1 for a first heat exchanging medium and an outlet port hole 2 for said first medium. It has also been provided with an inlet port hole 3 and an outlet port hole 4 for a second heat exchanging medium. The plate is of mainly rectangular outer shape and has been provided with a pressed herring bone pattern—not completely shown in FIG. 1—of ridges and depressions as normally done in the art.

Figure 2:
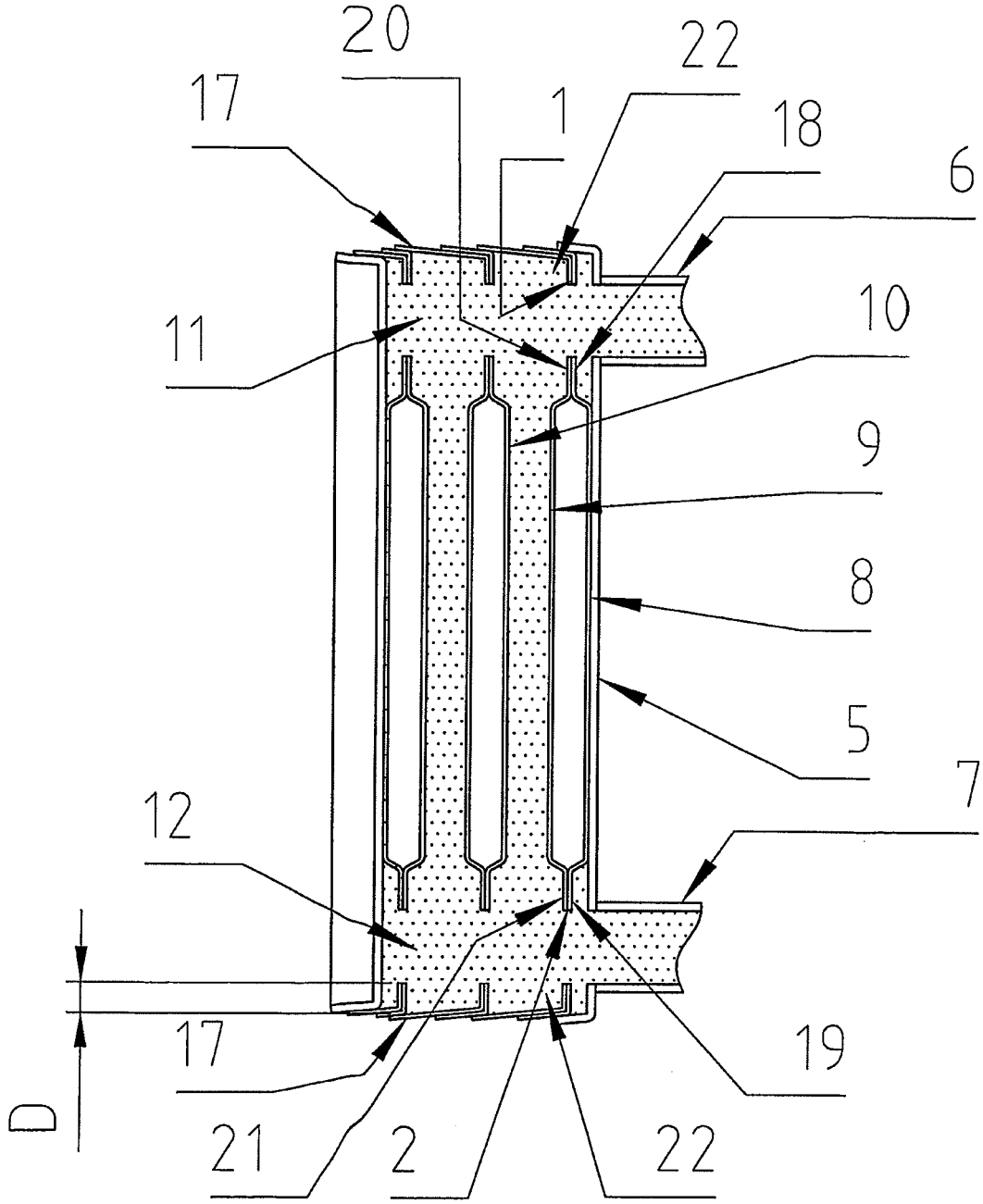
(Prior Art) Fig. 2

FIG. 2 shows schematically a vertical section through a known heat exchanger comprising a number of stacked plates of the type shown in FIG. 1—the section being taken along the line x-x in FIG. 1. The exchanger is provided with an end plate 5 connected to an inlet tube 6 and an outlet tube 7. The three first heat exchanging plates in the stack nearest the end plate 5 have been designated by 8, 9 and 10 respectively. Each heat exchanging plate in the stack has been turned 180 degrees in its plan relative its neighbouring plates. The space between the plates 9 and 10 will limit a part of the flow of the first heat exchanging medium from an upper inlet port channel 11 extending through all the inlet port holes 1 in each other of the exchanger plates down to a corresponding outlet port channel 12 extending through all the outlet port holes 2 in each other of the heat exchanger plates. The spaces between pairs of the remaining plates in the stack will guide similar part flows. The first flow of heat exchanging medium through the exchanger has been shown by hatching.

Figure 3:
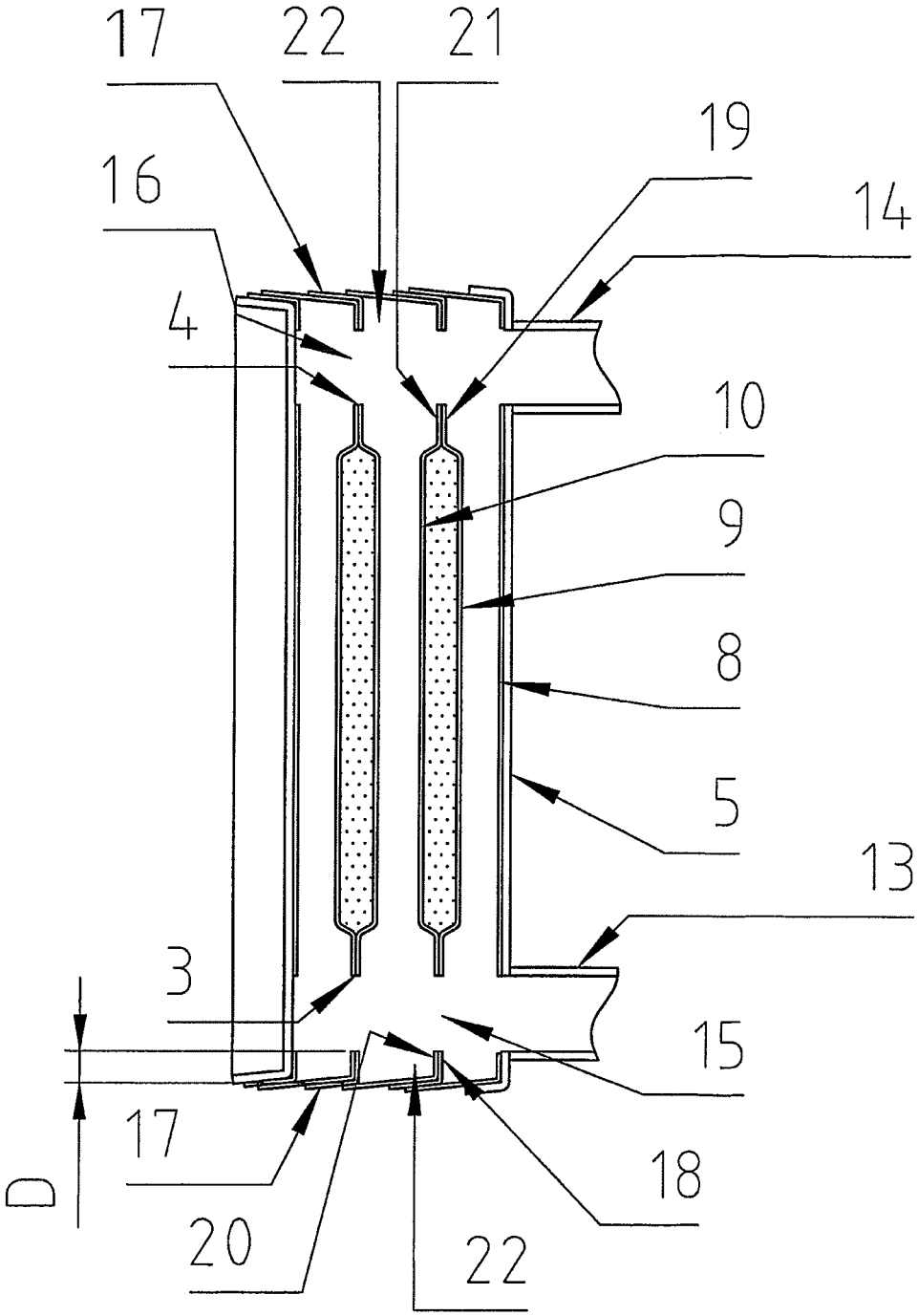
Fig. 3 (Prior Art)

FIG. 3 is a section similar to that of FIG. 2, but along the line y-y in FIG. 1. Parts of the heat exchanger already mentioned and shown in connection with FIG. 2 have been provided with corresponding reference numerals. The end plate 5 has been provided with an inlet tube 13 for the second medium to exchange heat and an outlet tube 14 for said second medium. The inlet tube 13 communicates with an inlet port channel 15 passing through all the port holes 3 in each other of the heat exchanging plates. The outlet tube 14 communicates with an outlet port channel 16 passing through all the port holes 4 in each other of the heat exchanger plates. The said second medium will flow upwards through the space between the plates 8 and 9 and the spaces between all other pairs of plates containing the first heat exchanging medium—also shown by hatching in FIG. 3.

As will be seen in FIG. 2 and 3 all plates are provided with a peripheral rim 17 extending nearly perpendicular to the plan of the plate. Each rim 17 will overlap the rim 17 of a neighbouring plate in the stack of plates and will by brazing the rims together provide seals against external leakage of fluid. They will also give mechanical strength to the heat exchanger.

As shown in FIG. 2 the pairs of plates—e.g. the plates 8 and 9—guiding the flows of the second heat exchanging medium through the exchanger are also brazed together along ring shaped areas 18 and 19 of the plate 8 contacting the areas 20 and 21 of the plate 9 which has been turned 180 degrees in its plan relative the plate 8. It will be seen in FIG. 2 and FIG. 3 that the contact areas 18 and 19 of the plate 8 have been pressed in the same direction as that of the rim 17, whereas the contact areas 20 and 21 of the plate 9 have been pressed in the opposite direction. As shown in FIG.3 the pairs of plates—e.g. the plates 9 and 10—guiding the flows of the first heat exchanging medium through the exchanger are connected by brazing along ring shaped areas 20 and 21 around the port holes 3 and 4 to the contact areas 18 and 19 also located around the port holes after having turned each other plate in the stack 180 degrees in its plan. The brazing around the port holes 1-4 will prevent mixing of the two heat exchanging fluids and also contribute to the mechanical strength of the exchanger. The ring shaped brazing areas 18-21 are shown also in FIG. 1. As the areas 18, 19 are depressed in the direction opposite to that of the areas 20,21 the heat exchanger plates are not symmetric with respect to a vertical central line. The herring bone pattern is a deviation from symmetric shape relative a horizontal central line The volumes of the heat exchanger designated by 22 and located between the port holes 3-6 in the plates of the exchanger and the adjacent parts of the rims 17 will have no heat exchanging capacity.

Figure 4:
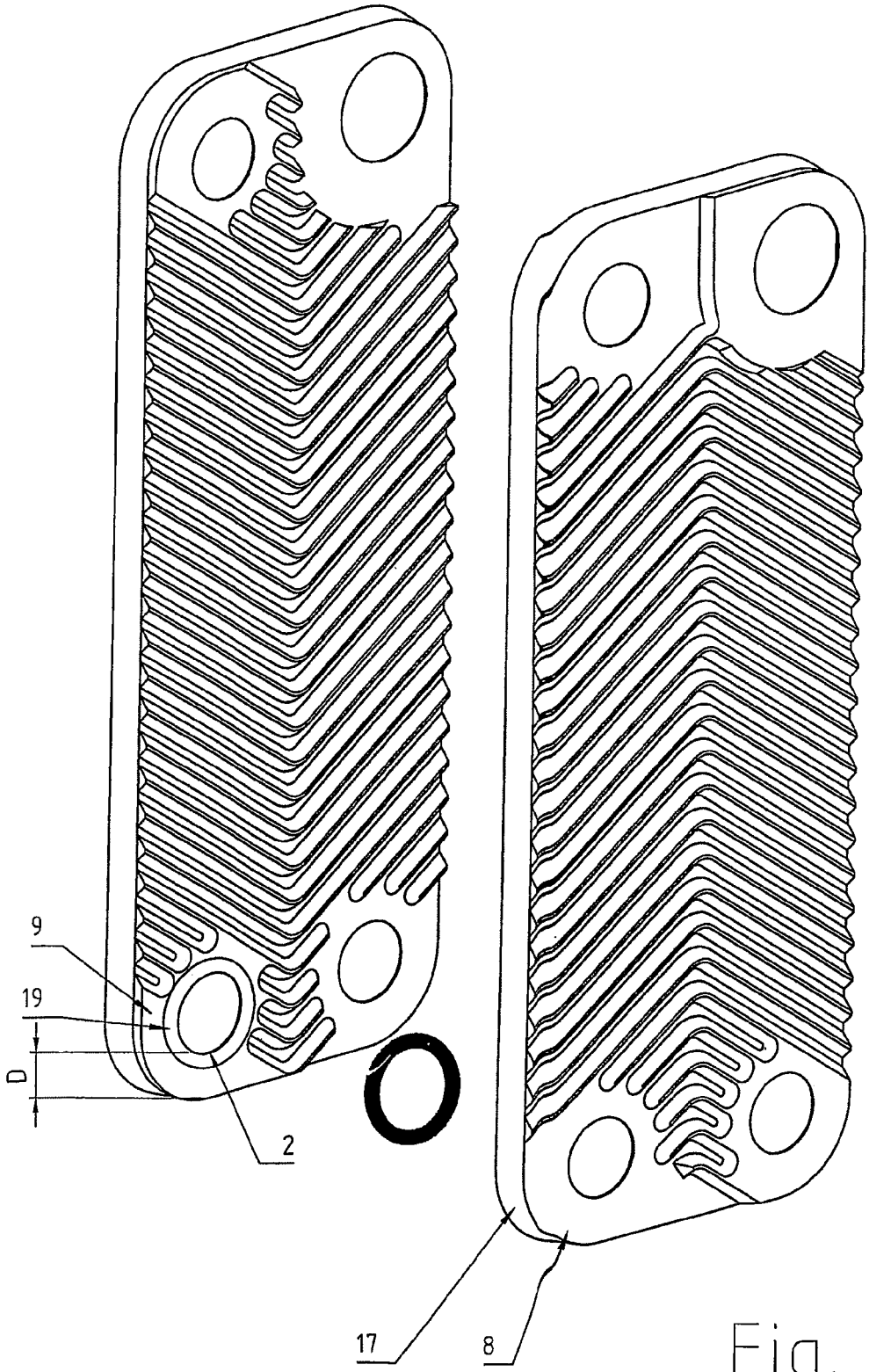
Fig. 4 (Prior Art)
FIG. 4 is a perspective view of two neighbouring heat exchanger plates of the type shown in FIG. 1 drawn apart in a stack of plates FIG. 5 schematically and from above shows a plate of a heat exchanger according to the invention.

FIG. 4 is a perspective view of the plates 8 and 9 already described above in connection with FIGS. 2 and 3, but at a greater scale and drawn apart and showing the brazing material used in the brazing connection around the port holes in the outlet port channel 12, said brazing material being separately placed between the two plates. It will be understood from the FIGS. 1-4 that a distance D will occur between the lowest edges of the port holes and the bottom of the exchanger. Thus it will not be easy to remove a liquid medium from the bottom of the exchanger and the volume of the heat exchanger between the port channel and the bottom of the exchanger will not contribute to the heat exchange.

Figure 5:
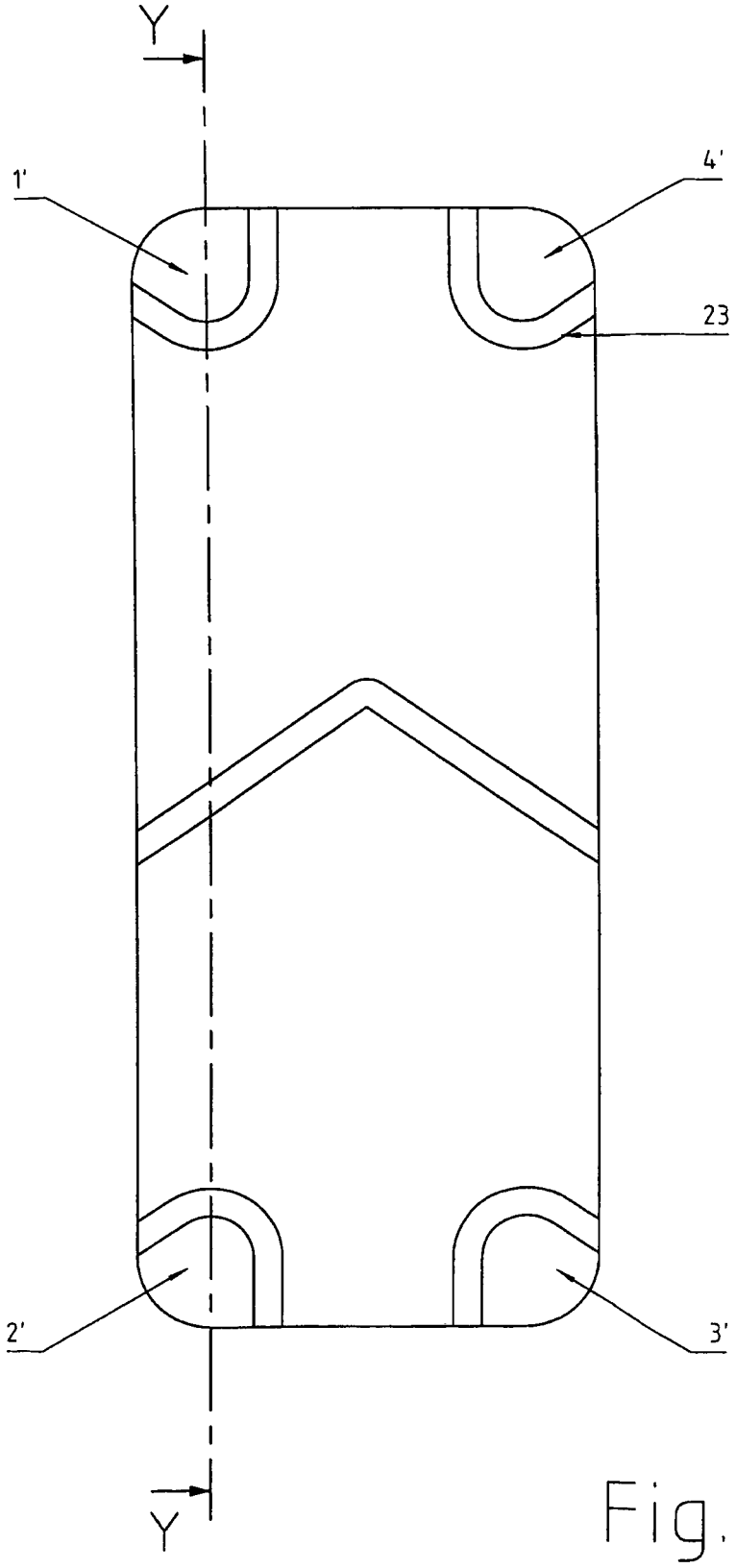

FIG. 5 shows schematically a heat exchanger plate to be used in an exchanger according to the present invention. The essential difference from the prior art is that the port holes 1', 2', 3' and 4' in the plate have been located near the corners of the heat exchanger plates. The band shaped plate areas 23 at the port holes in this figure do not form closed plan areas, but the lower edges of the lower port holes are located at the same level as the bottom of a heat exchanger. Thus any liquid phase of the two heat exchanging media will be easy to drain and any gaseous phase may be vented.

Figure 6:
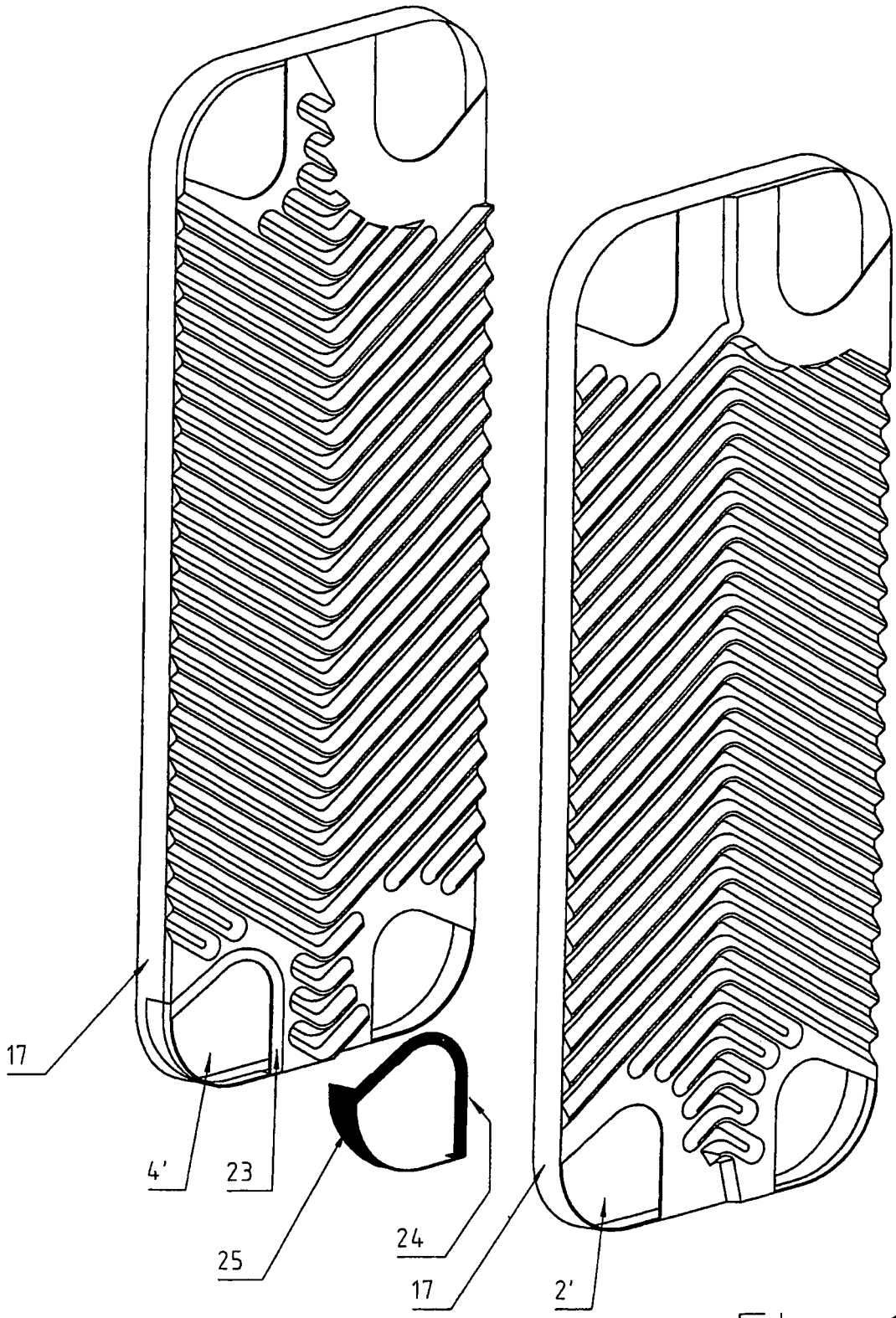
FIG. 6 is a perspective view of two neighbouring heat exchanger plates of the type shown in FIG. 5 drawn apart in a stack of plates, FIG. 7 schematically and from above shows another embodiment of a plate of a heat exchanger according to the invention.

FIG. 6 is a perspective view of two plates according to the invention and of the type shown in FIG. 5 which should be interconnected by brazing around port holes, e. g. the port holes 4' and 2'. The two plates (shown drawn apart) will be interconnected by brazing along the plan curved band area 23 bordering a part of the port hole 4' and a corresponding plan curved band area bordering a part of the port hole 2'. The remaining sealing of the port holes will be effected by brazing part cylindrical areas of the overlapping rims 17 at the periphery of the two neighbouring plates. The soldering material establishing the seal around the port holes will have the shape separately shown with solid black between the two plates drawn apart in FIG. 6. As will be understood the brazing providing seal between the plates will be effected in more than one plan, one part 24 of the seal being located in a plan parallel to the plans of the plates and the remaining part 25 of the seal being part-cylindrically shaped.

Figure 7:
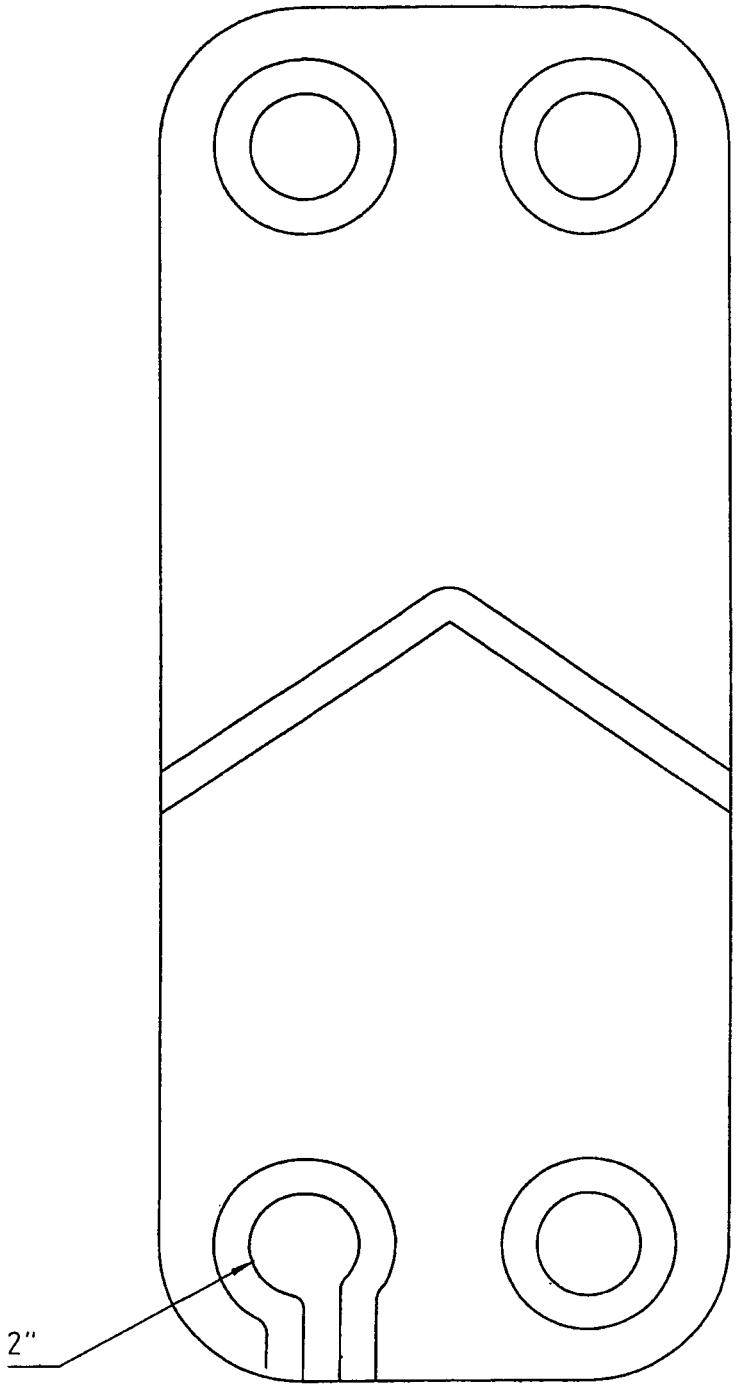

FIG. 7 shows a plate in which one of the port holes—designated by 2"—has the shape of a key hole extending to the lower edge of the plate.

Figure 8:
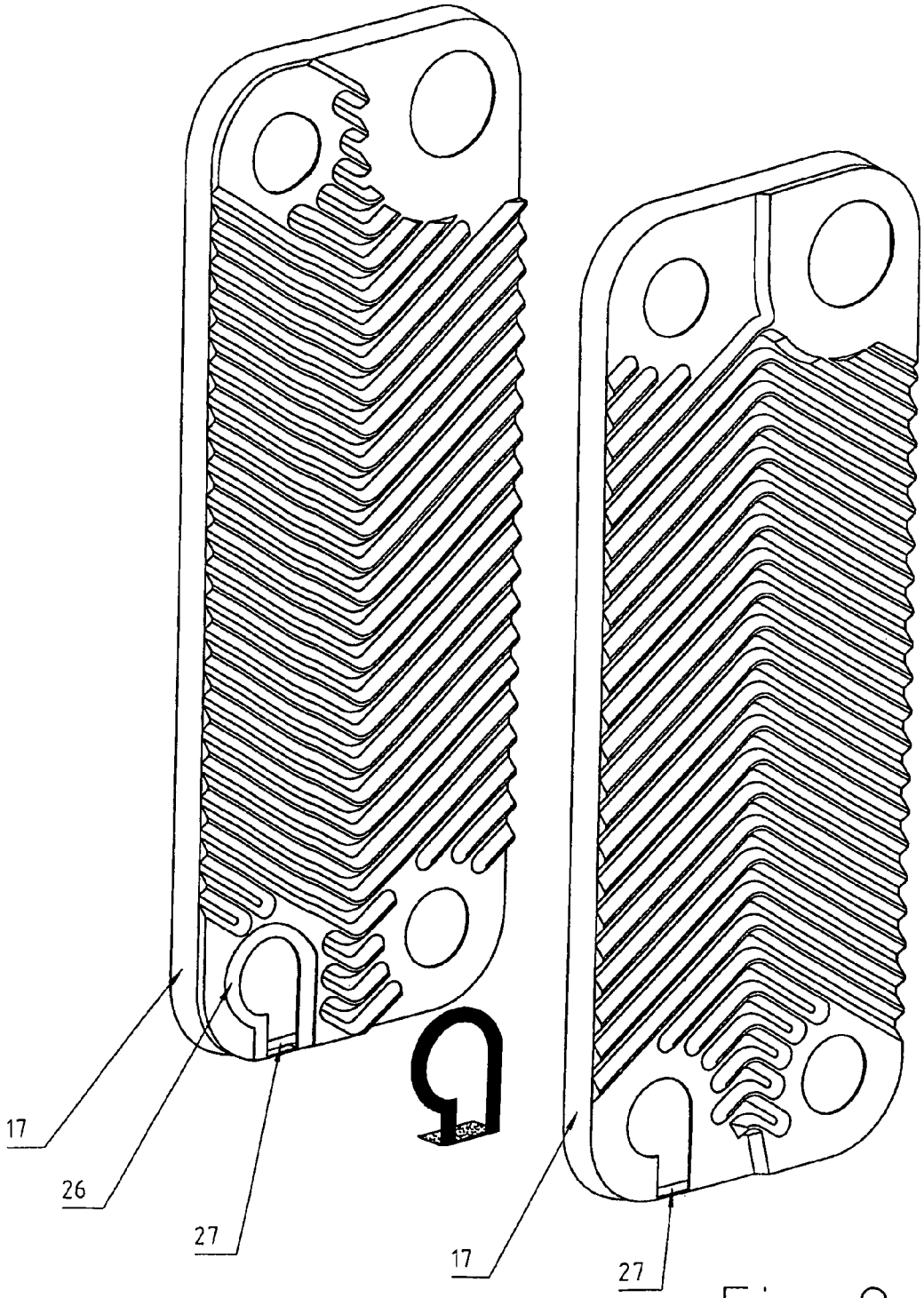
FIG. 8 is a perspective view of two neighbouring heat exchanger plates of the type shown in FIG. 7 drawn apart in a stack of plates, FIG. 9 schematically and from above shows still another embodiment of a plate of a heat exchanger according to the invention.

FIG. 8 corresponds to FIG. 6 in order to illustrate the shape of the sealing braze connection around two key hole shaped port holes in adjacent plates. Two plan sealing areas 26 and 27 have been shown—the plan area 27 being a part of the surface of the rim 17, while the plan area 26 is directed parallel to the general plan of the heat exchanger plates. I will be understood that the two sealing areas are located in plans which are perpendicular to each other.

The plates shown in FIGS. 7 and 8 deviate substantially from being symmetrically shaped. Therefore, the plates should not be turned in the stack, but two different types of plates should be used alternating in the stack. In one type of the plates the pressed herring bone pattern should be directed opposite the pressed pattern of the other type.

Figure 9:
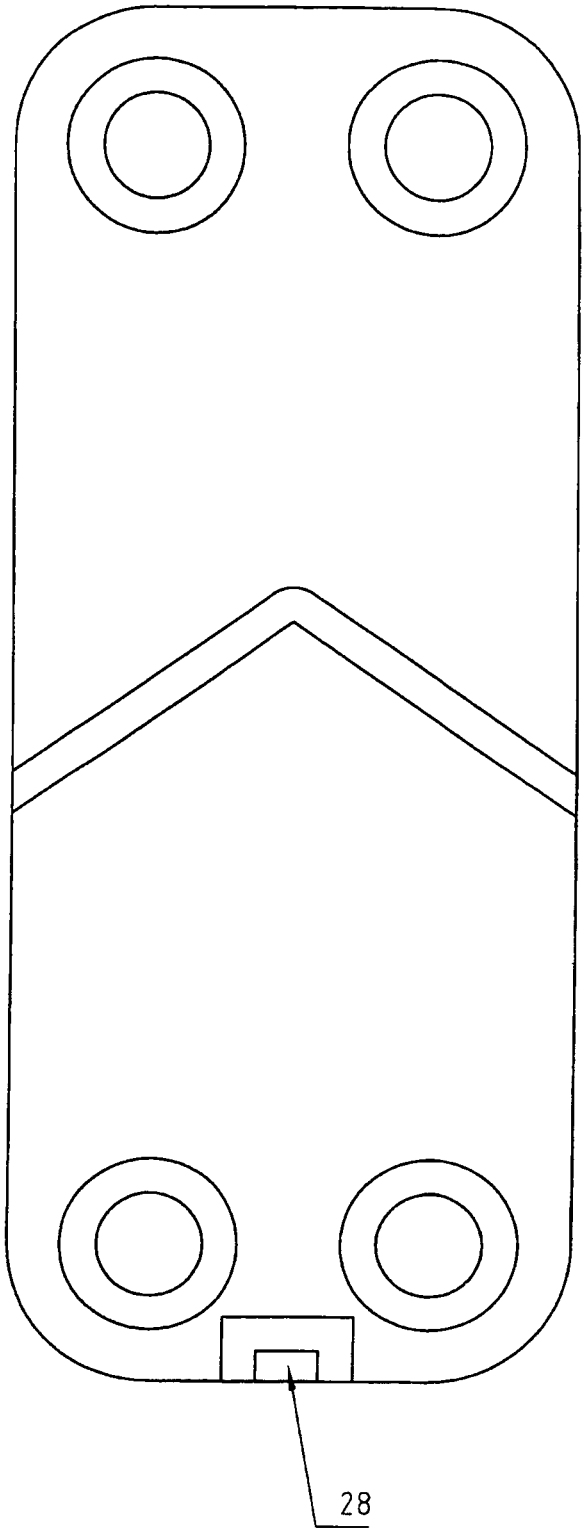

The plate shown in FIG. 9 contains an extra port hole 28 placed at the lower rim of the plate.

Figure 10:
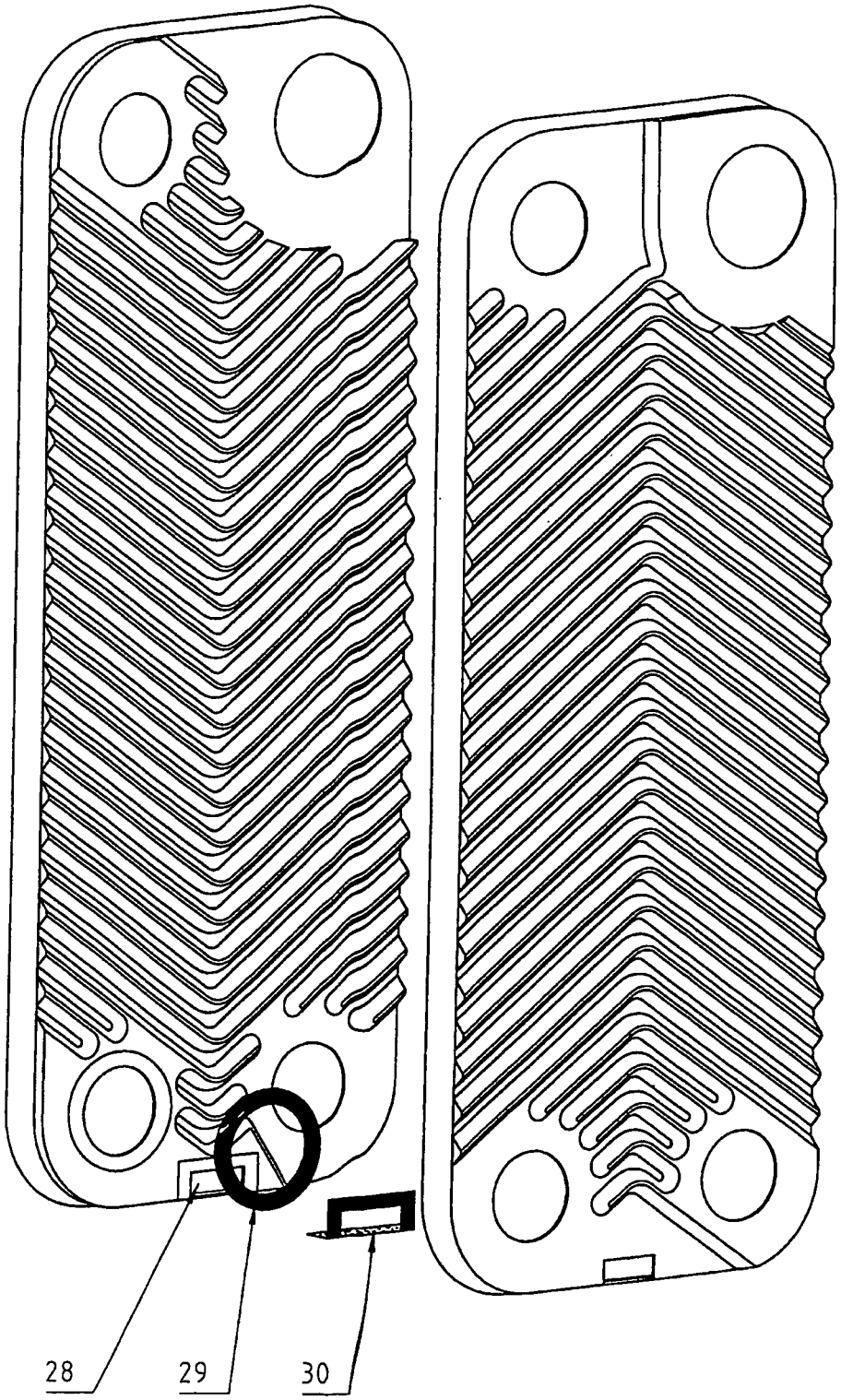
FIG. 10 is a perspective view of two neighbouring heat exchanger plates of the type shown in FIG. 9 drawn apart in a stack of plates.

FIG. 10 shows a sealing braze connection designated by 29 of traditional type in one plan connecting prior art port holes and a braze connection 30 in two plans at the extra port hole 28.

The extra port hole 28 located as shown in FIGS. 9 and 10 will form a supplemental port channel acting in parallel to the traditional lower port channel for one of the heat exchanging media—e.g. a gaseous medium liable to condensation.

The plates used in the embodiment shown in FIGS. 9 and 10 are also of two different types and should not be relatively turned in the stack.

The invention has been described in connection with two-circuit heat exchangers. However, it will be understood that the exchanger could comprise more than two heat exchanging circuits. It could be adapted to parallel as well as counter-current flows in the exchanger.

The invention claimed is:

1. A plate heat exchanger comprising:

(a) a plurality of stacked plates for guiding flows of a first heat exchanging medium and a second heat exchanging medium;

(b) said plates being brazed together to provide brazing connections along circumferential rims at a periphery of neighboring plates and around port holes present in pairs of neighboring plates to prevent mixing of the flows of the first and second heat exchanging medium when flowing through port channels comprising said port holes in the heat exchanger;

(c) wherein the port holes in at least one of the port channels in the heat exchanger includes a perimeter consisting of a plan curved band area and a portion of the circumferential rim so that a wall of the circumferential rim forms a fluid boundary of the port holes in at least one of the port channels, wherein the circumferential rims of neighboring plates overlap and extend nearly perpendicular to the plan curved band area;

(d) wherein the brazing connections at each of the port holes in the at least one of the port channels in the heat exchanger are provided between contacting parts of the neighboring plates located along the plan curved band areas and the overlapping circumferential rims;

(e) said brazing connections around each of the port holes in the at least one of the port channels being structured and arranged to allow drainage of the heat exchanger, and the brazing connections around each of the port holes in the at least one of the port channels each comprise a plan portion and a cylindrical portion, wherein the plan portion is located between the plan curved band area of neighboring plates and the cylindrical portion is located between the overlapping circumferential rims of neighboring plates, and the plan portion and the cylindrical portion attach together to form a seal for each of the port holes in the at least one of the port channels;

(f) wherein said port holes comprise an inlet port channel for the first heat exchanging medium, an outlet port channel for the first heat exchanging medium, an inlet port channel for the second heat exchanging medium, and an outlet port channel for the second heat exchanging medium, and the inlet port channels and the outlet port channels extend parallel to each other, and wherein the inlet port channels and the outlet port channels are constructed such that the first heat exchanging medium and the second heat exchanging medium flow into and out of the plate heat exchanger on a single side of the plate heat exchanger.

* * * * *